US005712918A

United States Patent [19]

Yoest

[11] Patent Number: 5,712,918

[45] Date of Patent: Jan. 27, 1998

[54] PRESS-FIT EAR WAX BARRIER

[75] Inventor: Robert S. Yoest, Deerfield, Ill.

[73] Assignee: Beltone Electronics Corporation, Chicago, Ill.

[21] Appl. No.: 378,812

[22] Filed: Jan. 27, 1995

[51] Int. Cl.[6] ..... H04R 25/00

[52] U.S. Cl. ..... 381/68.6; 381/69; 181/130

[58] Field of Search ..... 381/68.6, 69, 68, 381/69.2; 181/129, 130, 135

[56] References Cited

U.S. PATENT DOCUMENTS

| | | | |
|---|---|---|---|
| 1,830,198 | 11/1931 | French . | |
| 2,430,229 | 11/1947 | Kelsey | 381/68.6 |
| 4,296,829 | 10/1981 | Pedersen | 181/129 |
| 4,349,082 | 9/1982 | Gastmeier | 181/130 |
| 4,443,668 | 4/1984 | Warren | 179/156 |
| 4,553,627 | 11/1985 | Gastmeier et al. | 181/135 |
| 4,870,689 | 9/1989 | Weiss | 381/68.6 |
| 4,972,488 | 11/1990 | Weiss et al. | 381/68.6 |
| 4,984,277 | 1/1991 | Bisgaard et al. | 381/69.2 |
| 4,987,597 | 1/1991 | Haertl | 381/69 |
| 5,099,947 | 3/1992 | Guggenberger et al. | 181/130 |
| 5,105,904 | 4/1992 | Olsen | 181/128 |
| 5,278,360 | 1/1994 | Carbe et al. | 181/135 |

FOREIGN PATENT DOCUMENTS

| | | |
|---|---|---|
| 415944 | 7/1925 | Germany . |
| 0310866 | 9/1988 | Germany . |
| 0352954 | 7/1989 | Germany . |
| 684231 A5 | 7/1994 | Switzerland . |
| WO84/04016 | 10/1984 | WIPO . |

OTHER PUBLICATIONS

A Drawing and a Data Sheet for a Beltone OPTIMA Hearing Aid with a Removable Threaded Wax Guard on sale in the United States before Jan. 27, 1994.

European Search Report No. 96101134.3.

*Primary Examiner*—Sinh Tran

*Attorney, Agent, or Firm*—Dressler, Rockey, Milnamow & Katz, Ltd.

[57] ABSTRACT

An ear wax barrier for an in-the-ear or in-the-canal type hearing aid device positioned at least in part between a receiver output port and a shell acoustic output port includes a substantially cylindrical housing having a barbed portion for press-fitting the barrier into position. The barrier may include a screen and/or a plurality of undulations, such as a thread internal thereto for providing wax accumulation sites to retard the migration of wax into the hearing aid. The barrier is more easily inserted than removed.

5 Claims, 9 Drawing Sheets

PRESS-FIT EAR WAX BARRIER

FIELD OF THE INVENTION

This invention pertains to ear wax barriers for hearing aids. More particularly, this invention pertains to press-fit ear wax barriers for in-the-ear and in-the-canal type hearing aids.

BACKGROUND OF THE INVENTION

In-the-ear and in-the-canal type hearing aids have become accepted by the hearing impaired public for their small size, ease of use and relative comfort, as compared to older style hearing aids. Many of the in-the-ear and in-the-canal type devices include a shell which is designed to fit in the ear or ear canal of the user.

The shell may hold the electronic circuitry, a microphone, and a receiver. The microphone receives sound signals from outside of the device and responsively creates an electronic signal. The signal may be sent to an amplifying circuit which supplies a signal to the receiver. The receiver in turn, provides audio output to the ear.

Typically, in the in-the-ear and in-the-canal type devices, sound travels from an output port of the receiver, through a sound channel, and out of the device through an acoustical output port in the hearing aid shell. The sound may then travel through the user's ear and cause the tympanic membrane to vibrate.

The ears secrete a substance known as cerumen or ear wax. While ear wax cleans the internal structure of the ear, it also tends to flow into the sound channel and receiver of a hearing aid located in the ear. Ear wax which migrates into a hearing aid can degrade the effectiveness of the device and can eventually cause the device to fail.

A number of barrier products are presently available to prevent or reduce the migration of ear wax into a hearing aid. One such barrier design uses a fine mesh screen in the sound channel between the receiver and acoustical output port of the shell. While such a barrier reduces the migration of ear wax into the hearing aid, it suffers from the possibility of becoming clogged with wax.

More recently, barrier systems have been introduced which include a housing which threadedly interconnects the output port of the receiver and the acoustic port of the shell. The housing threads into a portion of the shell. The housing has an interior surface which includes projections extending inwardly thereof, creating a tortuous path for solid or semi-liquid ear wax migrating therethrough.

Such devices are disclosed in Weiss, U.S. Pat. No. 4,870,689, entitled "Ear Wax Barrier For A Hearing Aid" and Weiss et al., U.S. Pat. No. 4,972,488, entitled "Ear Wax Barrier And Acoustic Attenuator For A Hearing Aid," both of which patents are commonly assigned herewith, and both of which patents are hereby incorporated by reference.

In the devices disclosed in the Weiss and Weiss et al. patents, the barrier is incorporated into a housing, which has projections extending inward of the housing. The barrier is then threaded into the hearing aid shell. This design was a significant improvement over devices prior thereto.

Nevertheless, threading the barrier to the hearing aid requires additional mechanical components or alteration of the shell to effect the attachment.

Thus, there continues to be a need for hearing aid ear wax barriers which are easily inserted and removed without additional mechanical components and/or shell alterations. Preferably, such barriers would also provide an effective configuration for preventing the migration of ear wax into the hearing aid.

SUMMARY OF THE INVENTION

A press-fit ear wax barrier is provided for use with in-the-ear or in-the-canal type hearing aids. The hearing aid includes a shell with an acoustical output port and a receiver having a receiver output port positioned within the shell.

The barrier includes a housing which is adapted to be received at least partially intermediate the acoustical output port and the receiver output port. The housing includes a central acoustical passageway linking the acoustical output port and the receiver output port.

A mesh barrier element can be carried by the housing to impede the flow of ear wax into the acoustic passageway. Alternately, a plurality of undulations may extend inwardly of, and cooperate to occlude wax movement through, the acoustical passageway.

The undulations define traps or wax accumulation sites within the barrier. The accumulation sites retard migration of ear wax into the hearing aid.

The barrier also includes an exterior wall surface which has a substantially cylindrical portion having a predetermined diameter. A frusto-conical barb is located on an exterior end of the housing. The barb has a base area diameter which is larger than the diameter of the cylindrical portion. The barb permits press-fitting the barrier into a position at least partially intermediate the acoustical output port and the receiver output port.

In another aspect of the invention, the barrier undulations can be formed by a thread within the central acoustical passageway. The thread may be continuous or may be formed in discrete sections.

In one embodiment, the barrier includes a collar portion having a diameter greater than the diameter of the cylindrical portion to prevent over-insertion of the barrier. The collar portion may include a recessed area for receiving, for example, an attenuator screen.

In another embodiment, the housing serves as a press-fit connector to releasably couple, for example, the receiver output port to a receiver tube or channel, positioned between the receiver and the hearing aid shell. A press-fit wax guard of the type described above can be used in combination with the releasable receiver connector.

In yet another aspect of the invention, the structure can also function as an acoustic attenuator.

Other features and advantages of the present invention will be apparent from the following detailed description, the accompanying drawings, and the appended claims.

DETAILED DESCRIPTION OF THE PREFERRED EMBODIMENTS

Figure 1:
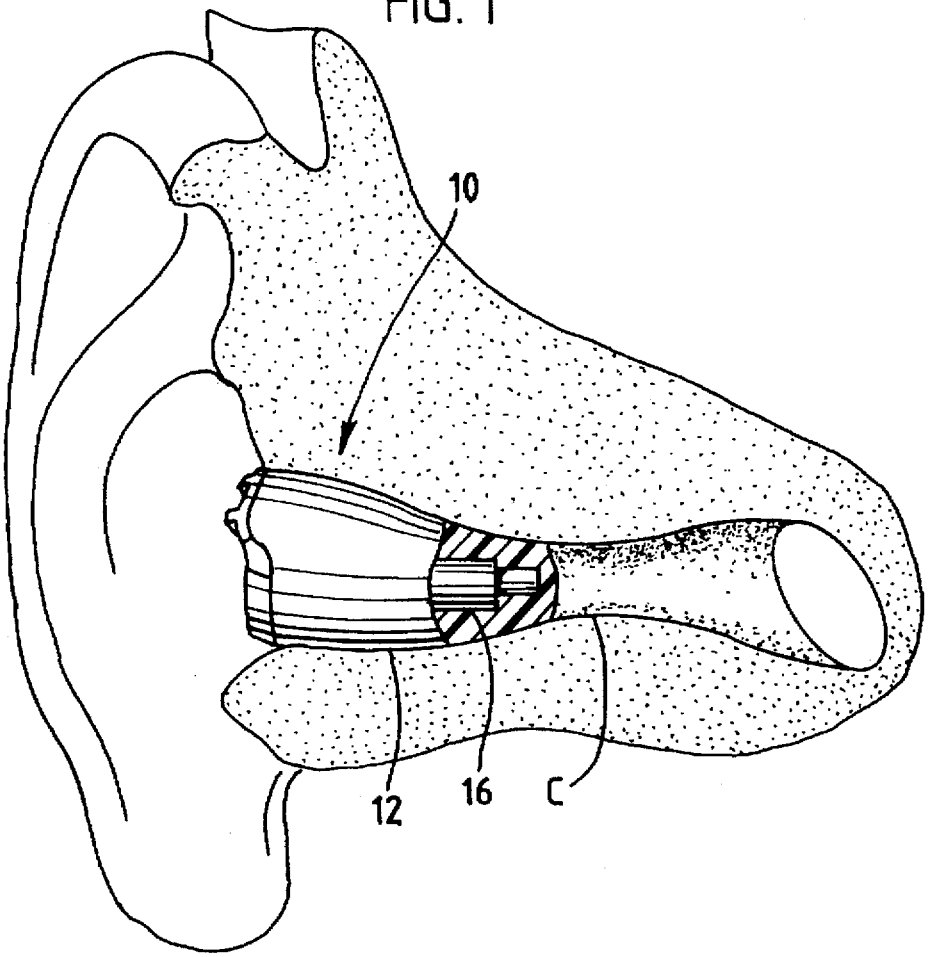
FIG. 1 is a partially broken away view of a hearing aid device, in accordance with the principles of the present invention, positioned in the ear canal of a user.

While the present invention is susceptible of embodiment in various forms, there is shown in the drawings and will hereinafter be described preferred embodiments with the understanding that the present disclosure is to be considered an exemplification of the invention and is not intended to limit the invention to the specific embodiments illustrated.

FIG. 1 illustrates an in-the-ear type hearing aid 10 positioned in the ear canal C of a user. It will be understood that the following comments also apply to in-the-canal type hearing aids.

Figure 2:
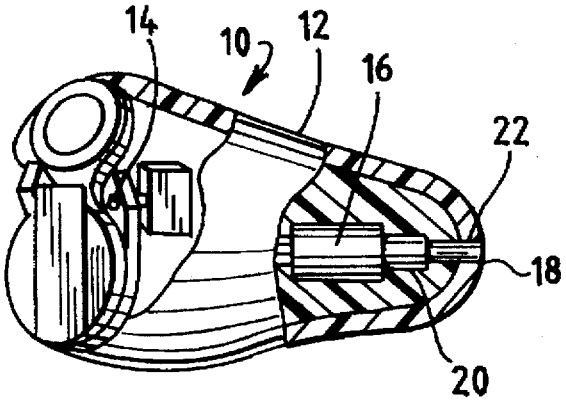
FIG. 2 is a partially broken away, perspective view of the device of FIG. 1.

As best seen in FIG. 2, the hearing aid 10 includes a shell 12, which supports or encloses a microphone 14, amplification circuitry (not shown) and a receiver 16.

The shell 12 and receiver 16 each include an acoustic output port 18 and 20, respectively. In a typical arrangement, sounds from outside of the hearing aid 10 are received at the microphone 14. The microphone 14 converts the sound into an electrical signal which is amplified in the amplification circuitry.

A responsive electrical signal is transmitted by the amplification circuitry to the receiver 16 which, in turn, creates an audio output. The audio output is transmitted from the receiver output port 20, via a receiver tube or channel 22 to the shell output port 18. The sound output may then be received at, and vibrate, the user's tympanic membrane, creating distinguishable sounds.

Figure 3:
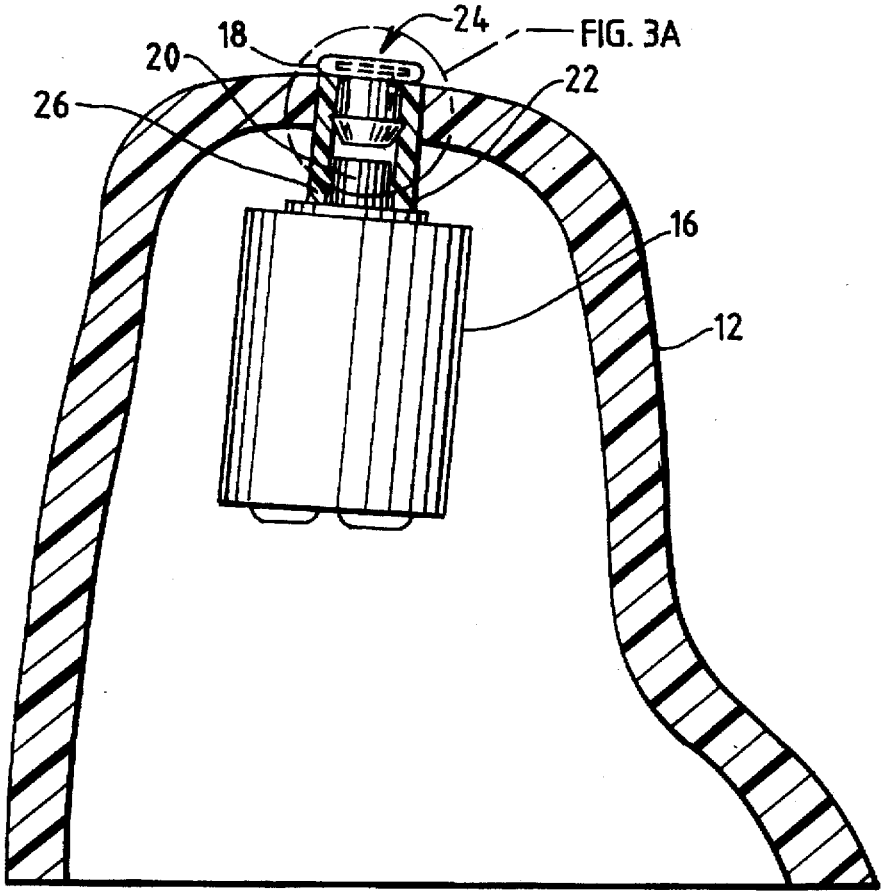
FIG. 3 is a partial cross-sectional view of a hearing aid shell having a receiver and an ear wax barrier positioned therein.

In one embodiment of the present invention, illustrated in FIG. 3, the receiver tube 22 interconnects the receiver 16 and the shell 12. The tube 22 penetrates the shell 12 at a location of the shell 12 which is positioned in the ear canal C. An ear wax barrier 24 is positioned in the tube 22 at a distal most portion 26 thereof.

Figure 3A:
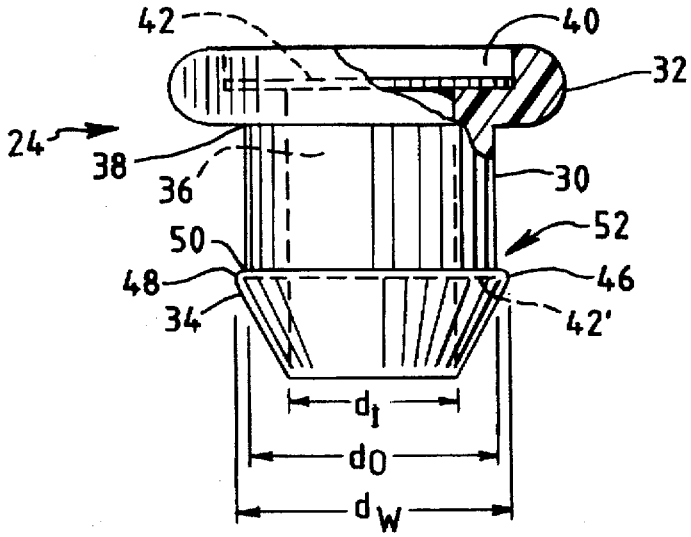
FIG. 3*a* is an enlarged, side elevational view of the ear wax barrier of FIG. 3, showing in broken lines, a central passageway.

Referring now to FIG. 3*a*, the barrier 24 includes a housing 30, a collar portion 32, and a barb 34. The housing 30 is cylindrical and includes a substantially cylindrical, central acoustical passageway 36 therethrough. The passageway provides acoustical communication between the receiver output port 20 and the shell output port 18.

The collar 32 which is located at a distal end 38 of the housing 30 has a larger diameter than the housing 30. The collar 32 prevents over-insertion of the barrier 24 into the tube 22. The collar may also include a recessed, preferably circular area, shown generally at 40, for receiving, for example, a barrier screen 42. In an alternate configuration, a barrier screen 42' may be positioned internal to the barrier 24, at a location approximately corresponding to the barb 34.

The size and number of openings in the screens 42, 42' may be varied as would be understood by those of skill in the art. The screens 42, 42' may also function as attenuators.

The barb 34 is located distally of the collar 32, and has a generally frusto-conical shape. The barb 34 surrounds the housing 30 and tapers to a diameter about equal to the inner diameter $d_i$ of the housing 30. The widest portion 46 of the barb 34, which is at a base portion 48 thereof, has a diameter $d_w$ larger than an outer diameter $d_0$ of the housing 30. A lip 50 is formed at the juncture, shown generally at 52, of the barb's widest portion 46 and the housing 30.

Figure 4:
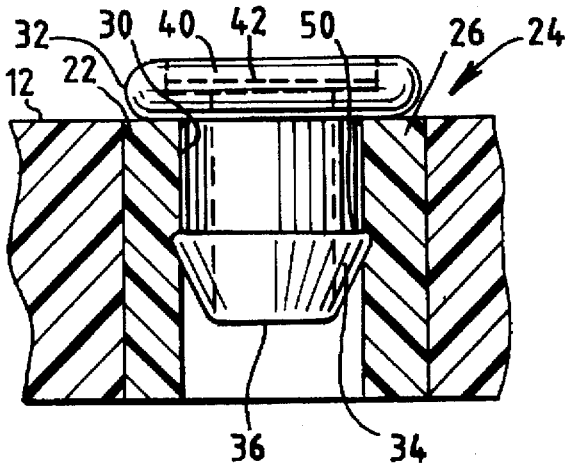
FIG. 4 is an enlarged, partial cross-sectional view of an ear wax barrier positioned in a receiver tube, in the shell of a hearing aid.

As shown in FIG. 4, the barrier 24 can be readily inserted, or press-fitted, without rotation, into the tube 22, without interference from the barb 34. The barrier 24, however, resists removal or dislodging by the frictional engagement of the lip 50 with the tube 22.

Figure 5:
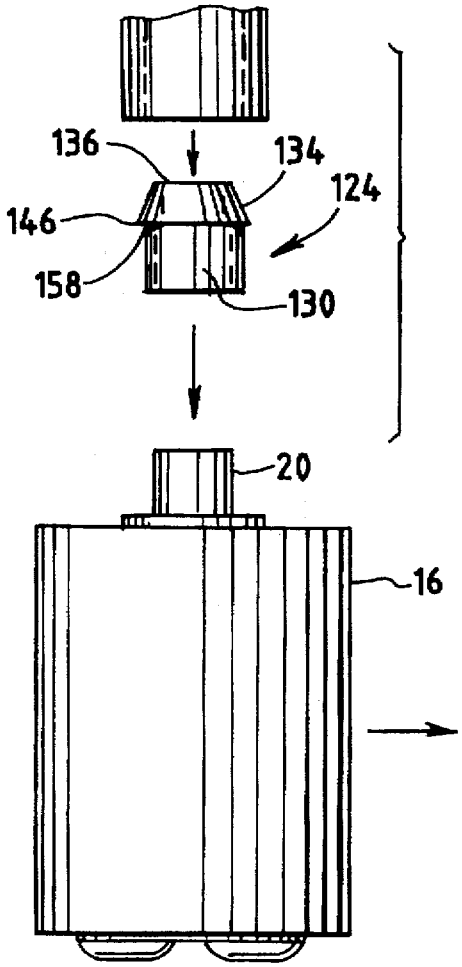
FIG. 5 is an exploded illustration of an exemplary arrangement for mounting the barrier between a receiver and a receiver tube.
Figure 5A:
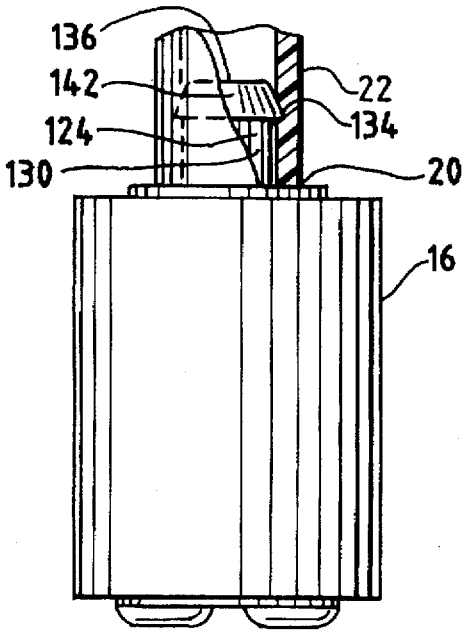
FIG. 5*a* illustrates the exemplary arrangement of FIG. 5, in the assembled configuration.

FIGS. 5 and 5*a* illustrate an alternate embodiment 124 which can function only as a connector or as a connector/barrier. The element 124 is collar-less. In the illustrated configuration, the element 124 is positioned adjacent to the receiver 16. In this arrangement, the element 124 is positioned on the receiver 16 at the receiver output port 20. The element 124 couples the receiver 16 to the receiver tube 22.

The element 124 could be integrally formed as a part of the output port 20, with or without a barrier screen such as 142. Alternately, the element 124 may be glued to the receiver output port 20.

The element 124 is positioned such that the barb 134 is directed away from the receiver 16, into the tube 22. This configuration makes it possible to releasably couple the receiver 16 to the audio output tube 22.

Figure 6:
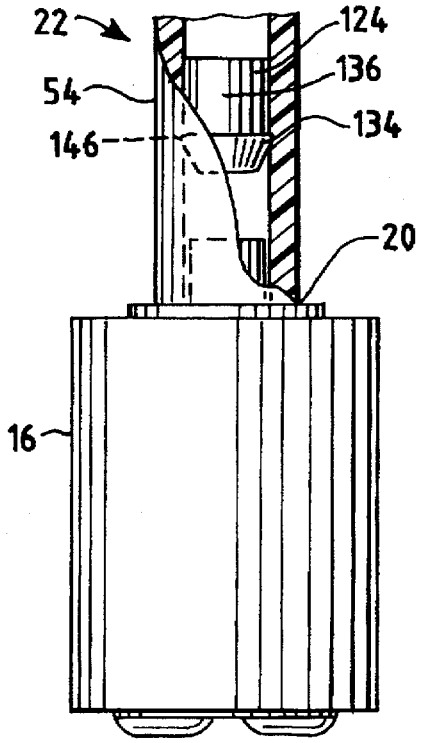
FIG. 6 is an alternate arrangement for mounting the ear wax barrier.

Another arrangement for mounting the element 124, is shown in FIG. 6. In this configuration, the element 124 is positioned in the tube 22 with the barb 134 directed toward the receiver 16. The element 124 can function as an attenuator or a wax guard in this configuration.

However, unlike the arrangement illustrated in FIGS. 5 and 5*a*, the element 124 shown in FIG. 6 is positioned at an intermediate portion 54 of the tube 22, between the receiver output port 20 and the shell output port 18. In this configuration, the tube 22 is mounted to the receiver 16, by methods which will be readily recognized by those skilled in the art, or as will be described later.

Figure 7:
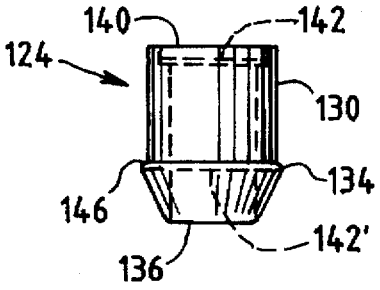
FIG. 7 illustrates the ear wax barrier of FIG. 6 including a barrier screen or an acoustic attenuator screen positioned therein.

As shown in FIG. 7, the collar-less element 124 can include a recessed area 140 which is adapted to receive, for example, a barrier or attenuator screen 142, or like device. Alternately, a barrier or attenuator screen 142' may be positioned internal to the element 124, at a location approximately corresponding to the barb 134.

Figure 8:
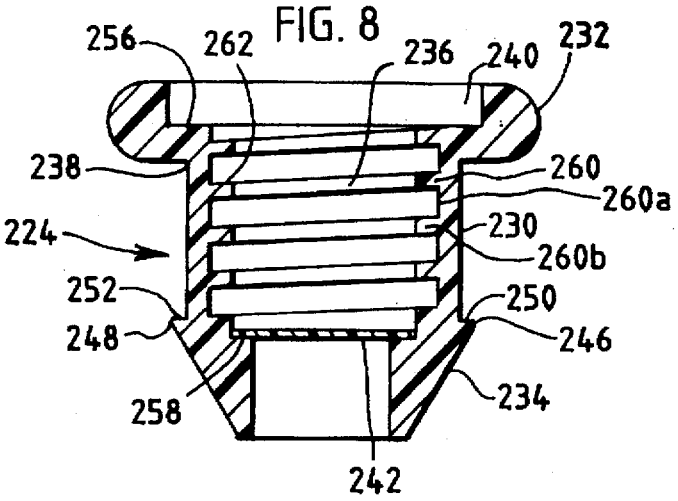
FIG. 8 is a cross-sectional view of an alternate embodiment of the ear wax barrier.

FIGS. 8–13 illustrate various embodiments of barriers in accordance with the principles of the present invention. FIG. 8 shows an embodiment 224 of the barrier having a housing 230, a collar portion 232, and a barb 234. The housing 230 defines a substantially cylindrical, central passageway 236 therethrough, which provides acoustical communication between the receiver output port 20 and the shell output port 18.

The embodiment illustrated in FIG. 8 includes the recessed area 240 at the collar portion 232, the juncture of which defines a first shoulder 256. A second shoulder 258 is formed internal to the housing 230 at a location which approximately corresponds to the widest portion of the barb 246.

The barrier 224 includes a plurality of undulations, shown as a thread 260, formed in the interior surface 262 thereof. The thread 260 is formed of a root 260*a* and a crest 260*b*, and creates a tortuous path for the migration of ear wax into the hearing aid 10. Essentially, the thread 260 defines traps by providing wax accumulation sites along the root 260a and the crest 260*b*, as well as across the thread 260.

The thread 260 may be formed in a continuous manner; alternately, the thread 260 may be formed in discrete sections. The thread 260 may also be formed as ridges (not shown) along the interior surface 262 of the housing 230.

In a preferred embodiment, the thread 260 extends between the first shoulder 256 and the second shoulder 258. The barrier 224 may also include, as previously discussed, a barrier screen 242. The screen 242 extends across the passageway 236, and may be positioned on either the first or second shoulder 256 or 258, respectively.

Figure 9:
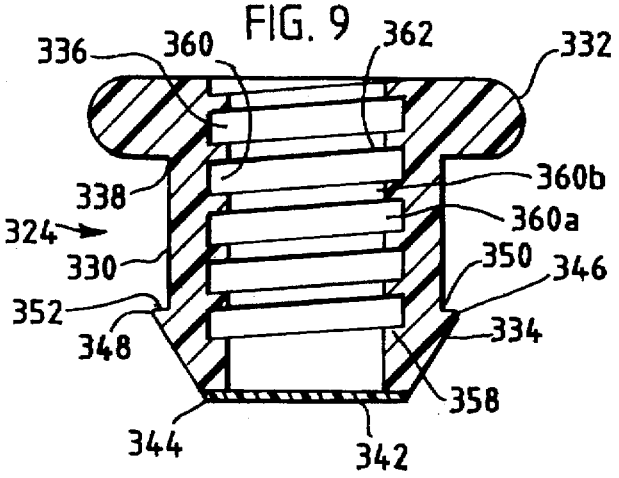
FIG. 9 is a cross-sectional view of still another embodiment of the ear wax barrier.

An alternate embodiment 324 is shown in FIG. 9. The barrier 324 is similar to that shown in FIG. 8, and includes, a housing 330, a collar portion 332, and a barb 334. The housing 330 defines a substantially cylindrical, central passageway 336 therethrough, which provides acoustical communication between the receiver output port 20 and the shell output port 18.

The embodiment 324 of the barrier illustrated in FIG. 9, includes the shoulder 358 internal to the housing 330, approximately positioned to correspond to the widest portion 346 of the barb 334. A thread 360 similar to that formed in the embodiment shown in FIG. 8, extends from about the collar 332 to the shoulder 358.

The embodiment shown in FIG. 9, however, does not include a recessed area at the collar portion 332. Rather, a barrier screen 342, if used, can be positioned across the shoulder 358. Alternately, the screen can be affixed to the barrier, at the proximal end 344 of the housing 330 adjacent to the barb 334.

Figure 10:
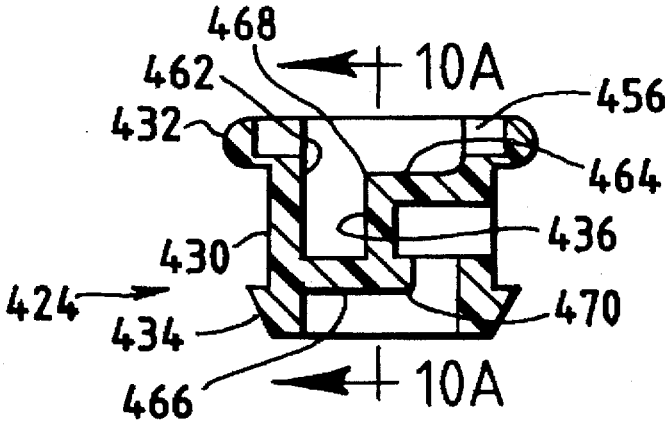
FIG. 10 is a cross-sectional view of still another embodiment of the ear wax barrier.
Figure 10A:
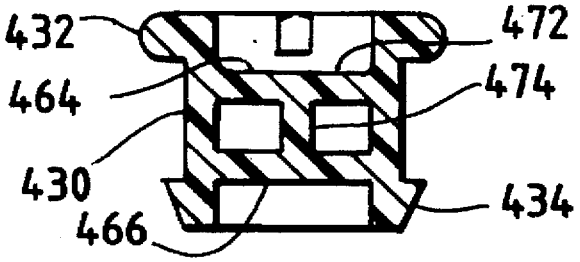
FIG. 10*a* is a cross-sectional view of the ear wax barrier of FIG. 10 taken along line 10*a*—10*a* of FIG. 10.

Another embodiment 424 is illustrated in FIGS. 10 and 10*a*. In this embodiment, upper and lower projections 464 and 466 extend inwardly of the barrier 424 opposing each other. The projections 464, 466 occlude the passageway 436 creating a tortuous path for the migration of ear wax. The projections 464, 466 terminate in ends 468 and 470, respectively. A rib 474 extends between the terminal ends 468 and 470, and provides additional wax accumulation sites.

Figure 11:
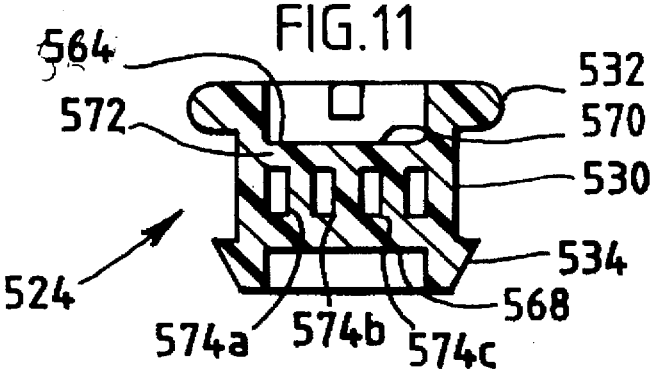
FIGS. 11 and 12 are cross-sectional views of still other embodiments of the ear wax barrier.

FIG. 11 shows an embodiment similar to that shown in FIGS. 10 and 10*a*. This embodiment of the barrier 524 incorporates a plurality of ribs 574*a–c*, extending between terminal ends 568 and 570, thus providing further wax accumulation sites.

Figure 12:
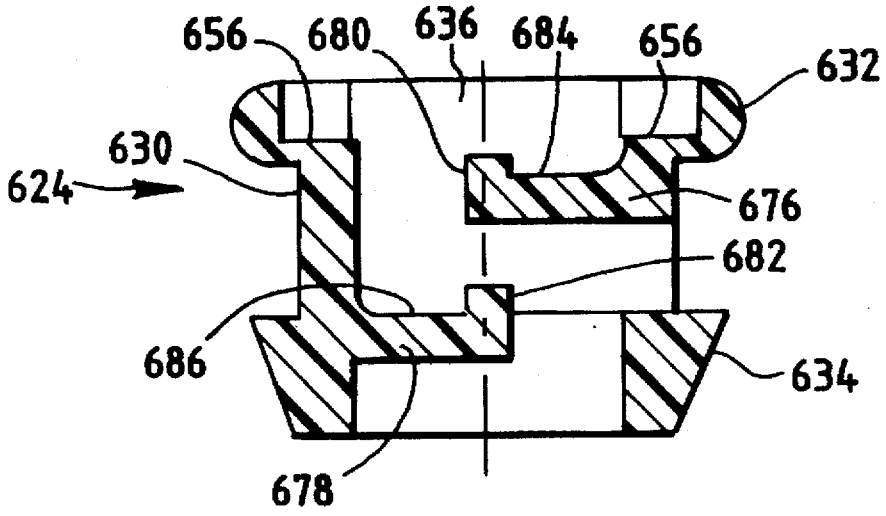

Still another embodiment 624 is shown in FIG. 12. The barrier 624 includes upper and lower projections 676 and 678, respectively, which extend inwardly of the barrier 624, and which occlude the passageway 636. Each of the projections 676 and 678 includes an upwardly extending flange portion 680, 682, respectively. The projections 676, 678, and flanges 680, 682, define trap means by providing wax accumulation sites 684 and 686, thereon.

Figure 13:
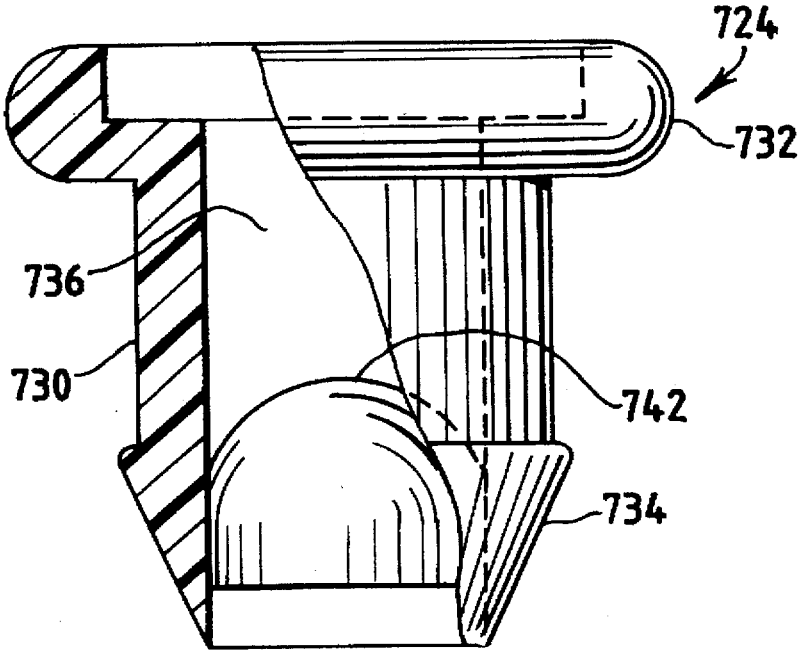
FIG. 13 is a cross-sectional view of an embodiment of the barrier having a curved or non-planar barrier screen.

Another embodiment 724 is shown in FIG. 13. This embodiment includes a barb 734 and a collar portion 732 on opposing sides of a housing 730. The housing 730 defines an uninterrupted central acoustical passageway 736 therethrough.

The barrier includes a barrier screen 742 positioned internal to the passageway 736, at a location approximately corresponding to the barb 734. In this embodiment of the barrier 724, the screen 742 is curved or formed concave relative to the barb 734. Other curved or non-planar arrangements are also possible.

Figure 14:
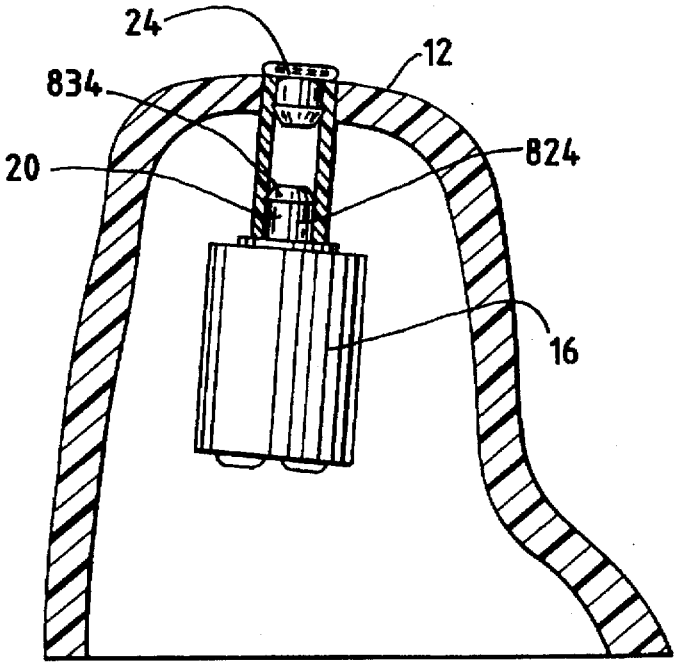
FIG. 14 is a partial cross-sectional view of a hearing aid shell having a receiver and an ear wax barrier positioned therein, the receiver being mounted to the hearing aid by a press-fit connector.

As shown in FIG. 14, one form 824 of the element may be used as a connector. The connector 824 may be mounted to, for example, a receiver output port 20, such as by gluing.

One end of a receiver tube or channel 22 may be connected to the barbed end 834 of the connector 824 to effect the connection. The other end of the tube 22 may be connected to a barrier (shown at 24) mounted to the tube 22 at the hearing aid shell 12.

Figure 15:
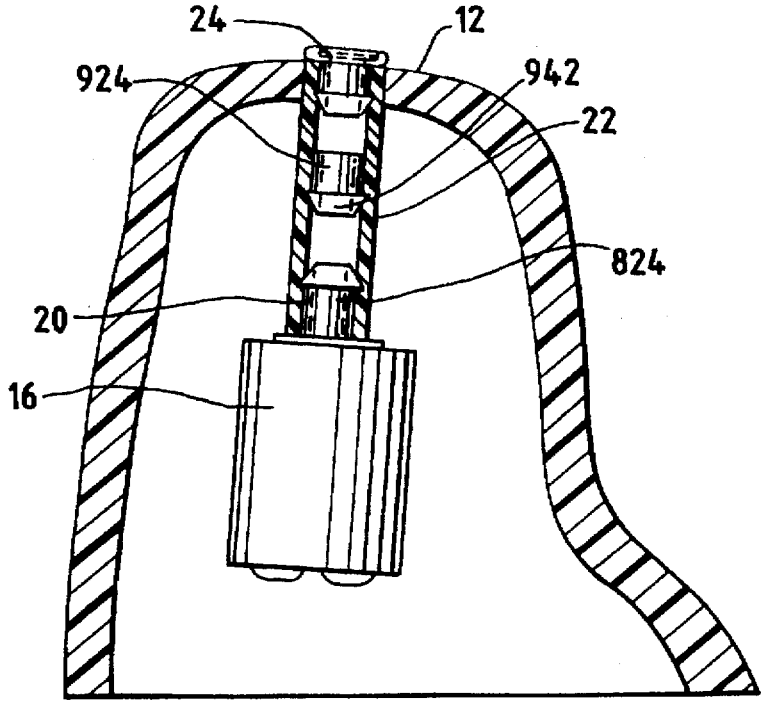
FIG. 15 is a view similar to FIG. 14, with the hearing aid further including an acoustic attenuator configured as a barrier.

FIG. 15 illustrates an alternate configuration. A connector 824 is mounted to the receiver output port 20. One end of the tube or channel 22 is mounted to the connector 824. The other end of the tube 22 is connected to a barrier 24 mounted to the tube 22 at the hearing aid shell 12.

An in-line attenuator 924 is positioned in the tube 22 intermediate the barrier 24 and the connector 824. The attenuator 924 may reduce or eliminate feedback or oscillations, or may smooth the frequency response characteristics in the hearing aid 10 circuitry.

The attenuator 924 may include a perforated member, such as a screen 942. The screen 942 perforations may be varied to produce differing attenuation characteristics.

Figure 16:
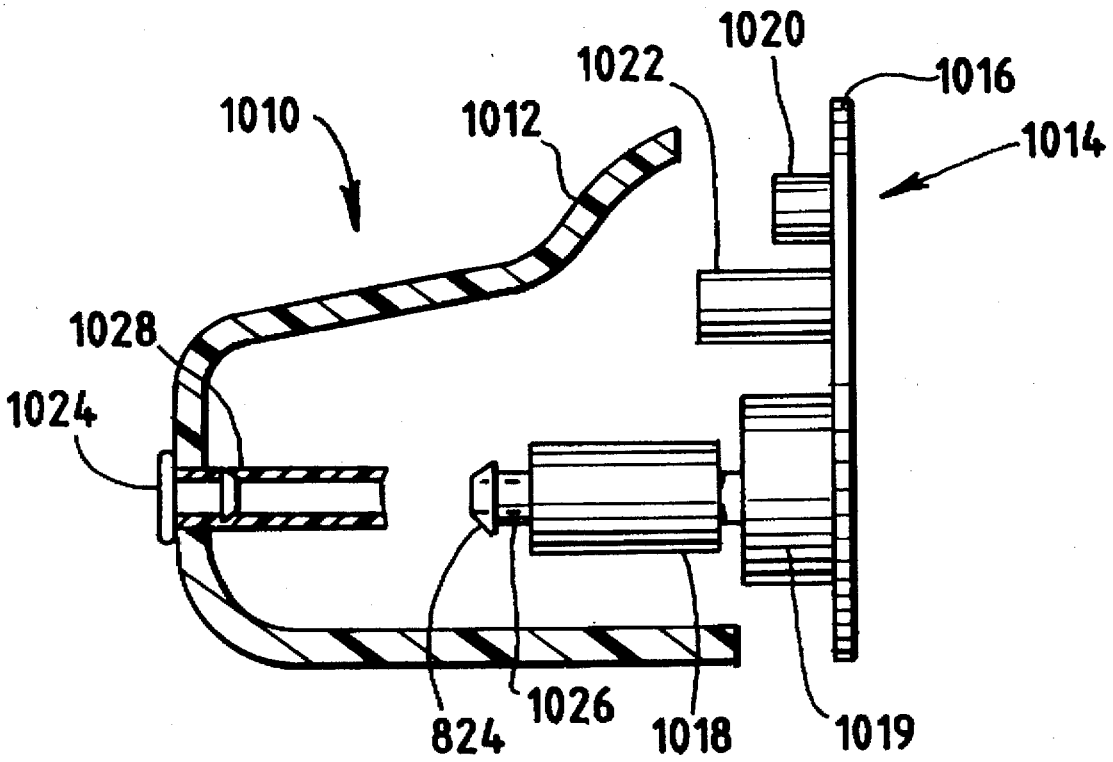
FIG. 16 illustrates an embodiment of a modular hearing aid with a press-fit connector in accordance with the principles of the present invention.

As shown in FIG. 16, one embodiment 1010 of a modular hearing aid includes a shell 1012 and a modular, removable circuit portion 1014. The circuit portion 1014 includes a mounting plate 1016, which may serve as an outer part of the hearing aid shell 1012. The plate 1016 is attached to the shell 1012 in normal operation.

The mounting plate 1016 may carry a receiver 1018 and amplification circuitry 1019 coupled thereto. A microphone 1020 and a battery 1022 are carried on the plate 1016 and are coupled to the circuitry 1019. The receiver 1018 has a barbed connector 824, such as the connector shown in FIG. 14, attached to a receiver output port 1026.

The shell 1012 includes a tube or channel 1028 mounted thereto. A barrier 1024, exemplary of which is the barrier illustrated in FIG. 3, is mounted to the tube 1028, at the shell 1012.

The modular circuit portion 1014 can be mounted to the shell 1012 with the connector 824 press-fitted to the tube 1028. This configuration permits easy separation of the shell 1012 from the circuit portion 1014 to facilitate maintenance of the hearing aid 1010. This configuration also permits replacement of the circuit portion 1014, without necessarily replacing or manufacturing a custom shell 1012.

Thus, ear wax barriers 24, 124, 224, 324, 424, 524, 624, 724 and 824 are disclosed for use with in-the-ear and in-the-canal type hearing aids 10, 1010. The barriers 24, 124, 224, 324, 424, 524, 624, 724 and 824 are readily adaptable to such hearing aids 10, 1010 without additional mechanical components or alterations in the hearing aid shell. The barriers 24, 124, 224, 324, 424, 524, 624, 724 and 824 resist ear wax migration by providing a tortuous path for solid or semi-liquid ear wax which secretes from the ear canal C and tends to clog or cause failure of such hearing aids 10, 1010.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A hearing aid with a removable ear wax barrier comprising:

a shell for insertion, at least in part, in the ear of a user, the shell including an acoustic output port;

a receiver positioned within the shell, wherein the receiver includes a receiver output port;

a thin walled receiver tube which extends between the receiver output port and the acoustic output port;

said removable ear wax barrier having a cylindrical body with first and second ends and an acoustic channel therebetween with a coupling barb carried at one end of the body surrounding the channel wherein the barb is adapted to be slidably inserted, without rotation, into the receiver tube adjacent to the acoustic output port wherein the barb continuously engages the tube with a press fit when so inserted, and wherein the body is not displaced from the receiver tube by rotation.

2. A hearing aid as in claim 1 wherein a portion of the barb is in contact with and compresses an adjacent region of the tube when the body is inserted.

3. A hearing aid as in claim 1 wherein the barb includes a retaining surface which extends radially from and substantially perpendicular to the body between the two ends with a tapered annular surface which extends therefrom toward the one end and wherein the portion of the barb adjacent to the intersection of the two surfaces deforms the tube when the barb is inserted therein.

4. A hearing aid as in claim 1 wherein the barb is configured such that it is easier to insert than to remove.

5. A hearing aid as in claim 1 wherein the second end of the body carries a radially extending shoulder which is adapted to abut the shell after the barb engages the tube.

* * * * *